US009233289B2

(12) United States Patent
Afonshin

(10) Patent No.: US 9,233,289 B2
(45) Date of Patent: Jan. 12, 2016

(54) METHOD FOR TRAINING PLAYERS AND SPORTSMEN

(76) Inventor: Vladimir Evgenievich Afonshin, Yoshkar-Ola (RU)

( * ) Notice: Subject to any disclaimer, the term of this patent is extended or adjusted under 35 U.S.C. 154(b) by 140 days.

(21) Appl. No.: 13/989,117

(22) PCT Filed: Nov. 29, 2011

(86) PCT No.: PCT/RU2011/000939
§ 371 (c)(1),
(2), (4) Date: May 23, 2013

(87) PCT Pub. No.: WO2012/096594
PCT Pub. Date: Jul. 19, 2012

(65) Prior Publication Data

US 2013/0288213 A1 Oct. 31, 2013

(30) Foreign Application Priority Data

Jan. 12, 2011 (RU) ..... 2011101282

(51) Int. Cl.
*A63B 69/00* (2006.01)
*A63B 71/06* (2006.01)

(52) U.S. Cl.
CPC ..... *A63B 69/00* (2013.01); *A63B 69/002* (2013.01); *A63B 69/0024* (2013.01); *A63B 69/0071* (2013.01); *A63B 71/0622* (2013.01); *A63B 2207/02* (2013.01)

(58) Field of Classification Search
CPC .. A63B 69/00; A63B 69/002; A63B 69/0024; A63B 69/0071; A63B 2207/02; A63B 15/20; A63B 24/0003; A63B 24/0021; A63B 24/0025; A63B 24/0028; A63B 24/0037
See application file for complete search history.

(56) References Cited

U.S. PATENT DOCUMENTS

2009/0036205 A1 * 2/2009 Seacat et al. ..... 463/30

FOREIGN PATENT DOCUMENTS

| | | | |
|---|---|---|---|
| DE | 102009044180 | A1 | 4/2011 |
| RU | 2139118 | C1 | 10/1999 |
| SU | 1741832 | A1 | 6/1992 |
| WO | WO03100568 | | 12/2003 |

* cited by examiner

*Primary Examiner* — Timothy A Musselman
(74) *Attorney, Agent, or Firm* — Aleksandr Smushkovich

(57) ABSTRACT

The invention relates to methods for training players and sportsmen. The technical result is an increase in the effectiveness of training. The method for training players and sportsmen with a piece of sports equipment on a pitch includes carrying out the training on a pitch that is provided with controllable dynamic lighting. The dynamic lighting is used to establish permitted zones in which the sportsman must be found, holding the piece of sports equipment. Further, the position, shape and area of the permitted zones are altered at random for the sportsman. The development of the sportsman's skill and the effectiveness of training are judged according to the sportsman's ability to stay in the permitted zones, holding the piece of sports equipment.

6 Claims, No Drawings

METHOD FOR TRAINING PLAYERS AND SPORTSMEN

CROSS-REFERENCE TO RELATED APPLICATIONS

This application is a U.S. national stage application of a PCT application PCT/RU2011/000939 filed on 29 Nov. 2011, whose disclosure is incorporated herein in its entirety by reference, which PCT application claims priority of a Russian Federation patent application RU2011101282 filed on 12 Jan. 2011.

FIELD OF INVENTION

The invention relates to methods for training players and sportsmen, particularly to methods for training players of football, hockey, basketball, and other sportsmen, requiring fast reaction and fine skills for using sport equipment.

BACKGROUND OF THE INVENTION

There is known a musical-illuminated floor with dynamic illumination. There is known a related art method for illuminating a theater scene by means of external dynamic illumination. A disadvantage of the related art method is lack of capability of programming game situations.

BRIEF DESCRIPTION OF THE INVENTION

The claimed invention provides for: a multi-option modeling of game situations with repetition thereof for fixation of required skills of the players; establishing artificial conditions effecting pedagogic and methodological advantages in comparison with natural game conditions.

The invention is directed to obtaining a utility result encompassing: an increase of efficiency of training sportsmen with sport equipment; working out coordination, reaction, and skills of using the sport equipment, by means of multi-option modeling of game situations.

The essence of the inventive method is a formation of dynamic illumination, setting up permitted zones, in which the sportsman should locate himself (i.e. keep staying) with a piece of sport equipment, the position, the zone shape and area, and the speed of changing the zones are to be varied, preferably, unpredictable for the sportsman, while imitating possible game situations, which significantly increases the efficiency of the training.

In most cases, the main purpose for the sportsman is to keep the piece of sport equipment in a conditionally permitted mobile illumination zone.

During the training session, the sportsman's coach (or another person) can manually guide the training, by using a manual projector or a large enough lantern with variable focus distance.

This creates a possibility of multi-optional modeling of various (simple, or complex) game situations.

Besides, the dynamic illumination can be controlled by a computer system in a selected mode. Preferably, this method is supposed to be used in real conditions of a playground (grass, ice, etc.), which increases attractiveness of the method for sportsmen.

The requisite result is achieved in the inventive method for training players and sportsmen with a piece of sport equipment on a playground, said inventive method comprises: providing the training on the playground with controllable dynamic illumination; wherein a novel feature is the establishing of permitted zones set with the help of dynamic illumination; the sportsman is supposed to locate himself and a piece of sport equipment in such a permitted zone; wherein the permitted zones change their position, shape and area; the sportsman's skill and the training efficiency are evaluated based on his ability to keep staying and holding the piece of sport equipment in the permitted zone.

The changing of the position, shape, and area of the permitted zones and training modes can be carried out manually or with the help of a computer system.

The training can be conducted in real conditions of a playground (e.g. on a green field for soccer players, or on a hockey field, or on a basketball ground, etc.).

The training of sportsmen on a playground with controllable dynamic illumination can be provided with permitted and prohibited zones for the player and the piece of sport equipment used by the player; wherein the changing of the position, shape, and area of the zones and training modes can be carried out by the player's coach manually or with the help of a computer system.

The playground can be illuminated with a combination of colors, whereas the character and rate of changing of the combination can be controlled by the player's coach manually or with the help of a computer system.

The players are supposed to continuously locate themselves and the piece of sport equipment in a permitted (e.g., green) zone, which is smoothly 'flowing', i.e. changes its position, shape, and area continuously and unpredictably for the players. When the player exercises a pass, a throw, or a hit during a movement around an assigned sector of the playground, it is convenient to determine the effectiveness of training in mathematical measures and observe the development of skill level of the player.

The inventive method utilizes simple technological means, and provides for a high efficiency of training.

The invention claimed is:

1. A method for training a player performing with a piece of sport equipment represented by a hockey puck, or a ball, said method comprising the steps of:

providing a playground;

providing a number of dynamic illumination devices;

providing the training of said player on said playground;

forming a number of permitted zones by projection of light onto said playground by means of said dynamic illumination devices; each of the permitted zones is characterized with a position on the playground, a shape, and an area; the permitted zones set locations, wherein the player is to position himself or herself, and keep staying and holding the piece of sport equipment;

by means of said dynamic illumination devices, varying the position and/or the shape, and/or the area of said permitted zones.

2. The method for training a player according to claim 1, wherein the training is characterized with a training mode; and wherein the position, the shape, and the area of said permitted zones, and the training mode are set by means of said dynamic illumination devices.

3. The method for training a player according to claim 1, wherein said varying the position, the shape, and the area of said permitted zones is provided with a predetermined speed, while imitating game situations by means of said dynamic illumination devices.

4. The method for training a player according to claim 1, wherein said dynamic illumination devices are provided in the form of a projector or a predeterminedly sized lantern.

5. The method for training a player according to claim 1, wherein said dynamic illumination devices are provided with a combination of colors.

6. A method for training a player performing with a piece of sport equipment represented by a hockey puck, or a ball; said method comprising the steps of:

providing a playground;

providing a number of dynamic illumination devices;

providing the training on said playground with said dynamic illumination devices;

forming a number of permitted zones by projection of light onto said playground by means of said dynamic illumination devices; each of the permitted zones is characterized with a position on the playground, a shape, and an area; the permitted zones set locations, wherein the player is to position himself or herself, and keep staying and holding the piece of sport equipment;

forming a number of prohibited zones by means of said dynamic illumination devices; each of the prohibited zones is characterized with a position on the playground, a shape, and an area; the prohibited zones set locations, wherein the player is not permitted to stay and to hold the piece of sport equipment; and varying the position and/or the shape, and/or the area of said permitted zones and said prohibited zones by means of said dynamic illumination devices.

* * * * *